US012371960B1

(12) United States Patent
Segura

(10) Patent No.: US 12,371,960 B1
(45) Date of Patent: Jul. 29, 2025

(54) FIELD ASSEMBLED INITIATOR

(71) Applicant: Baker Hughes Oilfield Operations, LLC, Houston, TX (US)

(72) Inventor: John W. Segura, Houston, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 0 days.

(21) Appl. No.: 18/429,329

(22) Filed: Jan. 31, 2024

(51) Int. Cl.
*E21B 23/04* (2006.01)
*E21B 29/02* (2006.01)
*E21B 43/119* (2006.01)

(52) U.S. Cl.
CPC ..... *E21B 23/0414* (2020.05); *E21B 29/02* (2013.01); *E21B 43/119* (2013.01)

(58) Field of Classification Search
CPC ..... E21B 23/0414; E21B 29/02
See application file for complete search history.

(56) References Cited

U.S. PATENT DOCUMENTS

| | | | | |
|---|---|---|---|---|
| 3,830,158 | A | 8/1974 | Di et al. | |
| 3,881,419 | A | 5/1975 | Bea | |
| 6,341,562 | B1 | 1/2002 | Brisighella | |
| 6,557,474 | B1 | 5/2003 | Morte et al. | |
| 6,915,744 | B2 | 7/2005 | Tirmizi | |
| 7,726,242 | B2 | 6/2010 | Stevens | |
| 8,161,880 | B2 | 4/2012 | Wuensche et al. | |
| 8,256,337 | B2 * | 9/2012 | Hill | F42B 3/12 89/1.15 |
| 9,347,755 | B2 | 5/2016 | Backhus et al. | |
| 10,077,641 | B2 | 9/2018 | Rogman et al. | |
| 10,899,680 | B2 | 1/2021 | Löhken et al. | |
| 11,549,343 | B2 | 1/2023 | Eitschberger | |
| 2019/0127290 | A1 | 5/2019 | Löhken et al. | |
| 2019/0292887 | A1 * | 9/2019 | Austin, II | F42D 1/05 |

FOREIGN PATENT DOCUMENTS

CN 101941410 B 4/2013

OTHER PUBLICATIONS

Daniel V. Gunter et al., "Design and Specification of a Ballistic Test Fixture and Data Acquisition System for Analysis of Bridge-Wire Initiators", 43rd AIAA Aerospace Sciences Meeting and Exhibit Jan. 10-13, 2005, Reno, Nevada, Published Jun. 21, 2012.

Peng Li et al., "Numerical Investigation of Pyrotechnical Initiators and Their Impact in Airbag Inflator Applications: Ballistic Modeling and Functional Analysis", Journal of Energy and Power Technology, vol. 3, issue 2, Jun. 28, 2021.

* cited by examiner

*Primary Examiner* — Matthew R Buck
(74) *Attorney, Agent, or Firm* — Bracewell LLP; Keith R. Derrington

(57) ABSTRACT

A reaction is instigated in an energetic material with an initiator having a chassis assembly and a cartridge. The chassis assembly and cartridge are transportable separate from one another and assembled on site. The chassis assembly includes a tubular penetrator with a beveled sharpened tip and a bridge wire mounted within the penetrator. The cartridge includes a sleeve and an amount of explosive inside the sleeve. When the initiator is assembled the penetrator inserts inside the sleeve and puts the bridge wire into direct contact with the explosive. The bridge wire is in electrical communication with a current source, and when selectively energized creates an explosion in the explosive to launch the reaction in the energetic material.

18 Claims, 7 Drawing Sheets

FIELD ASSEMBLED INITIATOR

BACKGROUND OF THE INVENTION

1. Field of Invention

The present disclosure relates to an initiator for initiating a reaction, which is assembled on-site.

2. Description of Prior Art

Exploration and production of fluids in a subterranean formation sometimes includes the use of an energetic material that undergoes a force producing reaction in a wellbore. The types of reactions typically include one or more of combustive, explosive, deflagrative, detonative, and oxidative; and the types of energetic material typically include combustible, explosive, propellants, oxidizers, and high explosives. Applications for these energetic materials include perforating, pipe cutters, packers, plug setting, and split shot, to name a few.

A way of starting the force producing reaction in energetic material is by directing a shock, flame, or detonation wave into the energetic material with an initiator. One type of initiator contains an amount of explosive, and a conductive element within the explosive. By directing a designated amount of current through the conductive element, a reaction is generated in the initiator explosive to create the shock wave and cause detonation of the energetic material. Transport of initiators having an amount of explosive is regulated with certain shipping restrictions, and increases the logistical complexity of delivering these timely to an on-site location.

SUMMARY OF THE INVENTION

Disclosed herein is an example method of instigating a reaction in an energetic material that includes obtaining a first tubular assembly having a chassis assembly mounted within that comprises a penetrator made up of an elongated annular barrel, a tip on an open end of the barrel, and a bridge wire inside the barrel, obtaining a second tubular assembly having a cartridge mounted within that comprises an annular sleeve having high explosive disposed within, forming an initiator by urging the tip into the high explosive to bring the bridge wire into close contact with the high explosive and coupling together the first and second tubular assemblies, and communicating a detonation of the high explosive to the energetic material. The initiator is optionally formed at a location that is distal from where the first and second tubular assemblies are assembled. In this example, the first tubular assembly is transported separate from the second tubular assembly to where the initiator is formed. Alternatively, the first and second tubular assemblies are assembled distal from one another. The detonation of the high explosive is optionally initiated by energizing the bridge wire with a designated amount of electricity that causes the bridge wire to fracture or produce heat radiance. The energetic material is part of a system that can be a perforating string, a bridge plug setting tool, or a pipe cutter. In an alternative, first and second caps are respectively mounted onto the first and second assemblies prior to transporting the first and second assemblies. In this example, spaces inside the first and second caps are optionally vented during the step of transporting. In an embodiment, the detonation of the high explosive is communicated in a direction parallel with an axis of the initiator or lateral to the axis of the initiator. During insertion of the penetrator into the high explosive, the penetrator is optionally rotationally static and the cartridge rotatable with respect to the penetrator.

Also disclosed herein is an example of a system for instigating a reaction in an energetic material that includes an initiator made up of a first tubular assembly having an annular first tubular, a cartridge assembly coaxially mounted within the first tubular, the cartridge assembly includes a penetrator that includes an annular barrel having an open end and an elongated bridge wire inside the barrel, and a second tubular assembly having an annular second tubular, a cartridge made up of an annular sleeve, and high explosive disposed inside the sleeve that is in close contact with the bridge wire when the penetrator is received inside the sleeve, the high explosive is strategically oriented, so that detonation of the high explosive communicates to the energetic material. The second tubular assembly is selectively changeable between a transportable configuration separate and decoupled from the first tubular assembly and an engaged configuration coupled with the first tubular assembly and in which the penetrator is inserted inside the sleeve. In an example, the system further includes a turntable assembly mounted on an end of the cartridge opposite where the penetrator inserts into the sleeve and that is rotatable with respect to the penetrator. In embodiments, the energetic material is part of a system which is a perforating string, a bridge plug setting tool, or a pipe cutter. The system optionally includes an electrical source in communication with the bridge wire that selectively provides electricity to the bridge wire in an amount to result in detonation of the high explosive. In an embodiment, the high explosive is thermite, high explosive, non-compressed high explosive, a variable density secondary explosive, or a combination thereof.

BRIEF DESCRIPTION OF DRAWINGS

Some of the features and benefits of the present invention having been stated, others will become apparent as the description proceeds when taken in conjunction with the accompanying drawings, in which.

Figure 1:
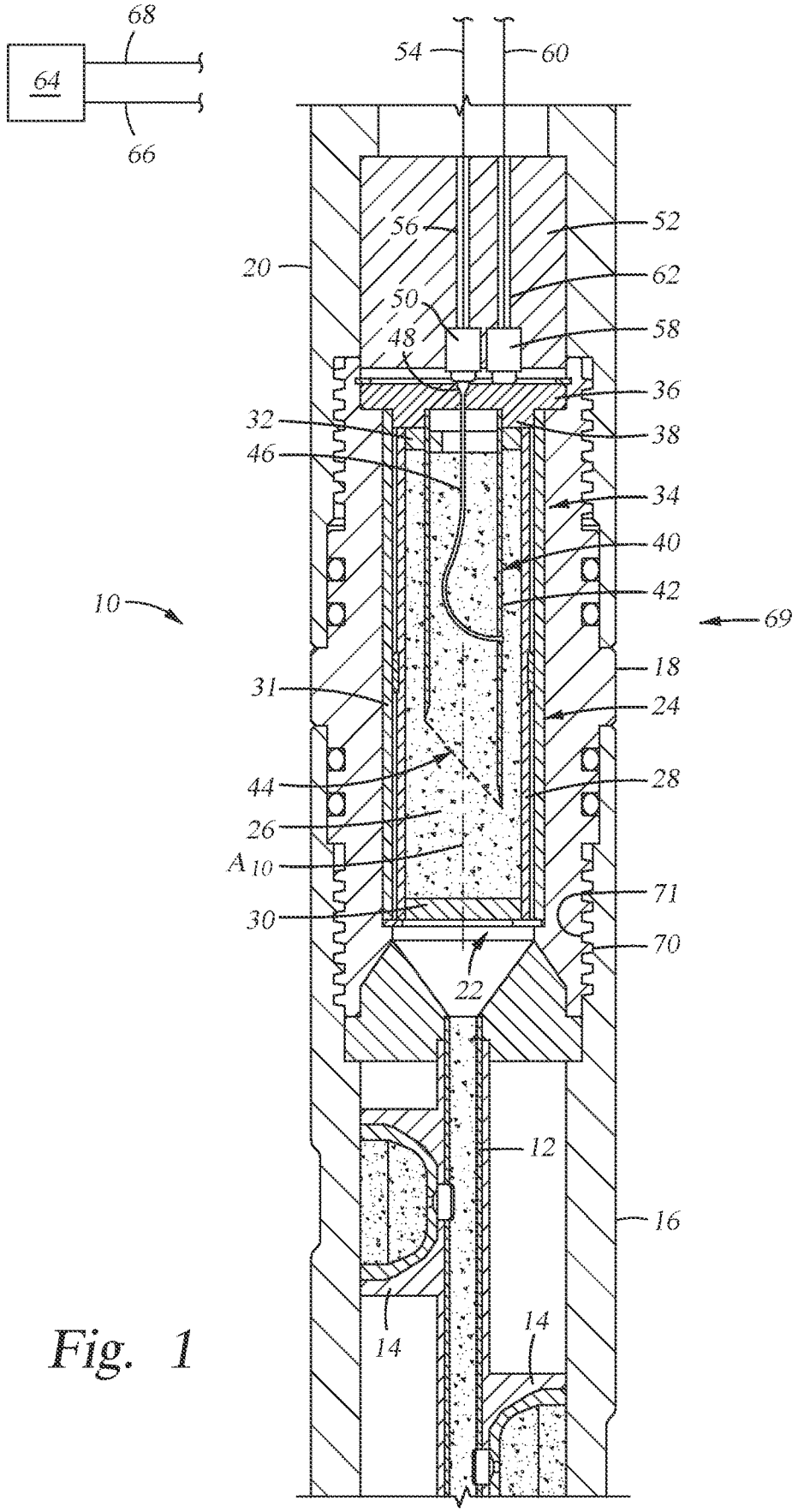
FIG. 1 is a side sectional view of an example of an initiator coupled to a perforating string.

While subject matter is described in connection with embodiments disclosed herein, it will be understood that the scope of the present disclosure is not limited to any particular embodiment. On the contrary, it is intended to cover all alternatives, modifications, and equivalents thereof.

DETAILED DESCRIPTION OF INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of a cited magnitude. In an embodiment, the term "substantially" includes +/−5% of a cited magnitude, comparison, or description. In an embodiment, usage of the term "generally" includes +/−10% of a cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Shown in FIG. 1 is a side sectional view of an example of an initiator 10, which is for creating a detonation within a detonating cord 12 shown coupled with shaped charges 14 inside a gun body 16. As disclosed in more detail below, the initiator 10 optionally provides detonation within other devices and systems, such as a tool for setting a plug downhole, a thermal cutter, a pipe cutter, and a wellbore packer initiator. An annular tandem body 18 is shown being part of initiator 10 and coupled with an annular upper body 20. In the alternative of FIG. 1, tandem body 18 is threadingly attached to an end of the upper body 20. A bore 22 extends axially within tandem body 18, which is substantially parallel with axis $A_{10}$ of initiator 10. Inside the bore 22 is a cartridge 24, which includes an amount of explosive 26 disposed in an annular sleeve 28. Examples of explosive 26 include thermite, high explosive, non-compressed high explosive, a variable density secondary explosive, and combinations. A disk like plug 30 is optionally provided on a lower end of sleeve 28 for retaining explosive 26 within sleeve 28. Optionally, an annularly shaped housing 31 is shown disposed within the inner surface of bore 22 and circumscribing sleeve 28. On an upper end of sleeve 28 opposite from plug 30 is an upper plug 32, which in this example has a configuration and construction substantially similar to that of plug 30. Plugs 30, 32 provide a way of keeping explosive 26 within sleeve 28. In this example cartridge 24 is coupled with the gun body 16, and in alternatives is rotational relative to the gun body 16.

Included in this example of initiator 10 is a chassis assembly 34 shown coupled with the upper body 20 by a base 36. In the example shown, base 36 has a planar disk-like portion that is oriented substantially perpendicular with axis $A_{10}$, and a boss 38 that projects axially from the planar portion towards plug 30 and inserts within an upper end of housing 31. An elongated penetrator 40 is shown, which includes an annular barrel 42 having a base end that mounts within the inner radial surface of boss 38, and a free end distal from the base end shown extending into the explosive 26 within sleeve 28. A tip 44 is defined on the free end of the penetrator 42, which has a beveled profile, and is angled with respect to axis $A_{10}$, so that sidewall lengths of barrel 42 differ about the circumference of barrel 42. In examples, the configuration of tip 44 is similar to a hypodermic needle. In the example shown, when forming the initiator 10 penetrator 40 is inserted through plug 32, and the beveled and angled tip 44 enables tip 44 to penetrate through the plug 32 without damaging or otherwise disturbing the portion of plug 32 shown radially outward from sidewalls of barrel 42. Within barrel 42 is an elongated bridge wire 46 having a base end that terminates into a contact 48 disposed within base 36, opposite from base end is a barrel end that connects to an inner surface of barrel 42. In the example of FIG. 1, the length of bridge wire 46 is strategically determined so that bridge wire 46 extends through a designated amount of the explosive 26, so that when a particular amount of electricity is applied to bridge wire 46, a detonation wave is created within explosive 26. Determining the length of bridge wire 46 and the particular amount of electricity is within the capabilities of one skilled in the art.

Still referring to FIG. 1, on a side of contact 48 opposite bridge wire 46 is a contact 50 shown mounted within a plug 52. In the example shown, plug 52 is a cylindrical member disposed inside a bore of upper housing 20 and abuts a side of base 36 opposite boss 38. Plug element 52 is a substantially solid member and made up of a dielectric material. A line 54 electrically connects to a side of contact 50 opposite contact 48 and extends through a passage 56 that is formed axially through plug element 52. Another contact 58 is embedded within a surface of plug element 52 adjacent base 36 which is in electrical communication with barrel 42. In an embodiment, bridge wire 46 and barrel 42 include substantially electrically conductive material. Contact 58 connects to a line 60 shown extending through a passage 62 formed axially within plug 52 and spaced radially away from passage 56. In a nonlimiting example of use, a power source 64 selectively provides electricity to the bridge wire 46 via leads 66, 68 that connect (not shown) to the lines 54, 60. A firing head 69 is defined by the combination of the initiator 10 within the tandem sub 18 and upper sub 20 along with the lines 54, 60. In the example of FIG. 1, threads 70, 71 are provided onto the outer surface of the tandem sub 18 and in an upper surface of gun body 16 for mounting firing head 69 to the gun body 16.

Figure 2:
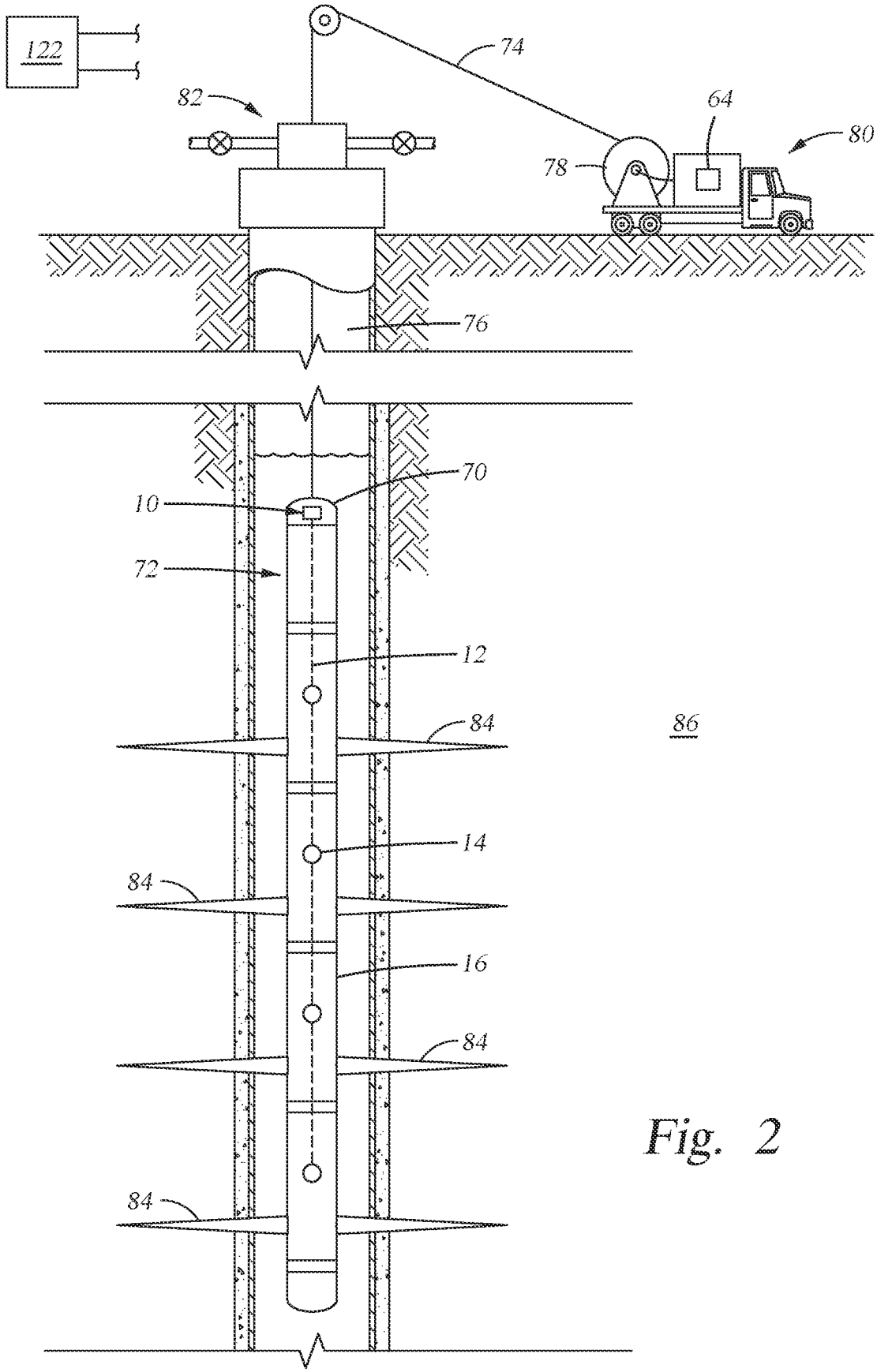
FIG. 2 is a side partial sectional view of an example of the perforating string of FIG. 1 deployed in a wellbore.

In FIG. 2 is a side sectional view of an example of using the initiator 10 in a wellbore operation. In the example shown, a number of gun bodies 16 are arranged in series to define a perforating string 72, which is suspended on a wireline 74 within a wellbore 76. A length of wireline 74 is retained on a spool 78 shown mounted onto a surface truck 80. Schematically depicted in the example of FIG. 2, the power source 64 is optionally within service truck 80, in alternatives power source 64 is included with string 72 or on another location on surface. Wireline 74 extends through a wellhead assembly 82 that mounts on an upper end of the wellbore 76 for pressure control and other wellbore operations. In the example of FIG. 2, detonation initiated in explosive 26 transfers to shaped charges 14 (FIG. 1) via detonating cord 14 to form perforations 84 that project radially into a formation 86 intersected by the wellbore 76. As noted above, the initiator 10 is not limited to use with a perforating string 72 but has other uses in wellbore operations as well as those on the surface and in nonrelated oilfield uses.

Figure 3:
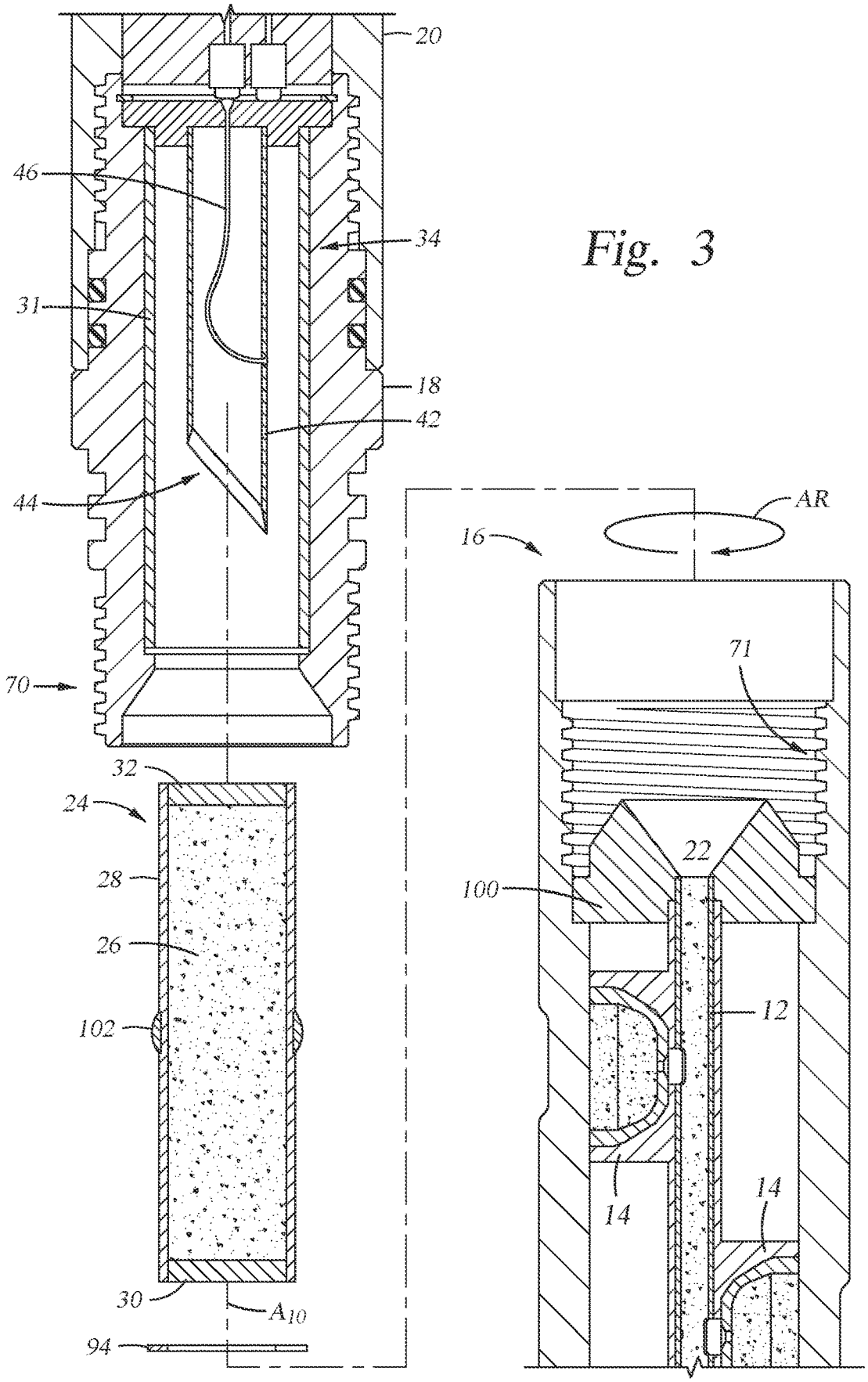
FIG. 3 is a side partial sectional view of an example of assembling the initiator of FIG. 1.

Referring to FIG. 3, shown in a side sectional view is an example of the initiator 10 of FIG. 1 prior to its assembly and the chassis assembly 34 and cartridge 24 being spaced axially away from one another. In the example shown, chassis assembly 34 is mounted within the upper body 20 and the cartridge 24 is coupled onto the gun body 16. The tandem sub 18 is threadedly attached onto the upper body 20, the respective lengths of the tandem body 18 and barrel 42 are such that the tip 44 is within bore 22 of tandem body 18 and shielded from impact by other objects when handling the upper housing 20 and tandem sub 18. Dimensions of the gun body 16 and sleeve 28 allow a portion of the cartridge 24 to be outside of gun body 16 and exposed. In a non-limiting example of assembly, the tandem body 18 and upper body 20 are urged in the direction of arrow A and along axis $A_{10}$ so that threads 70 of tandem sub 18 are brought into contact with threads 71 of the gun body 16. During this time, the barrel 42 is urged into contact with plug 32, and by virtue of the beveled and angled tip 44 penetrates through plug 32 so that barrel 42 and bridge wire 46 are inserted within sleeve 28 to bring bridge wire 46 into direct contact with the explosive 26.

In examples in which the tandem sub 18 and gun body 16 are equipped with threads 70, 71 as shown, engaging the tandem sub 18 with gun body 16 requires relative rotation between these two members. To avoid the damage to lines 54, 60 that could result of a relative rotation of the chassis assembly 34 with the upper housing 20, cartridge 24 is rotational about axis $A_{10}$ and with respect to the chassis assembly 34. In the example shown, a snap ring 94 is provided for coupling the cartridge 24 to a support structure 100 mounted inside gun body 16. Snap ring 94 allows for relative rotation between cartridge 24 and support structure 100 and gun body 16, so that barrel 42 and cartridge 24 are rotationally static (i.e., without relative rotation) with one another while connecting tandem sub 18 with gun body 16 and during make up of threads 70, 71. Maintaining cartridge 24 and barrel 42 rotationally static to one another as barrel 42 is urged axially within cartridge 24 avoids rotational forces or torque from being applied to bridge wire 46 from explosive 26. In an example, snap ring 94 secures into respective grooves (not shown) formed respectively in sleeve 28 and support structure 100 (or other structure coupled with gun body 16). As snap ring 94 is rotational with respect to support structure 100 so that relative rotation, as illustrated by arrow AR, is provided between chassis 24 and gun body 16 and with the chassis assembly 34. An annular seal 102 is shown provided on an outer surface of the sleeve 28, and which in examples defines a barrier to flow in the space between sleeve 28 and housing 31 when the cartridge 24 is inserted within the housing 31. In an alternative, cartridge 24 is coupled to structure 100 by a snap ring (not shown) that allows cartridge 24 to rotate relative to the structure 100. In an alternative, a turntable assembly (not shown) is used for allowing relative rotation between cartridge 24 and gun body 16, which includes an elongate pin (not shown) having an end mounted into a lower end of plug 30, an opposite end of pin that inserts into an aperture (not shown) formed axially through a planar baseplate (not shown) spaced axially away from a lower end of plug 30. Baseplate is supported onto or affixed to support structure 100 or other structure connected in gun body 16.

Figure 4:
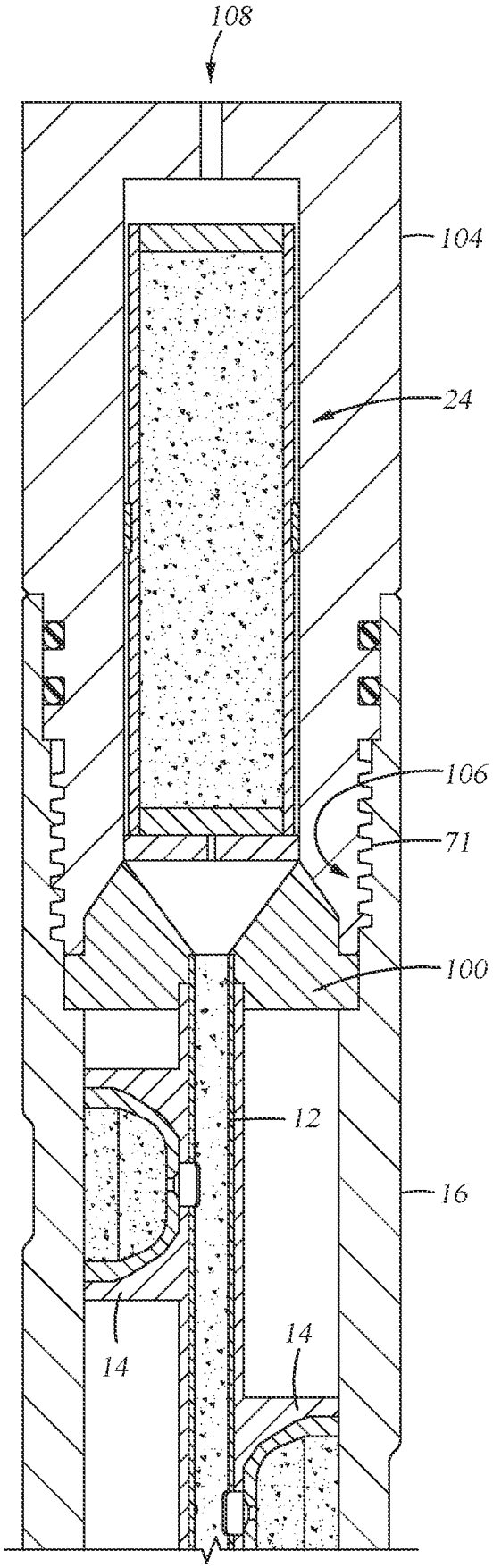
FIG. 4 is a side sectional view of an example of shipping a portion of the initiator having an energetic material.

Referring now to FIG. 4, shown in a side sectional view is an example of a transportation configuration of the cartridge 24. In this example, the cartridge 24 mounted onto the support structure 100, which is secured in a terminal end of the gun body 16. In the transportation configuration of FIG. 4, a cap 104 is shown engaged with an upper end of the gun body 16 via threads 71. In examples, cap 104 is a generally cylindrical member and which materials include polymeric or elastomeric materials that are resilient but yet stiff enough to provide protection for the cartridge 24 during transportation. Thread 71 engage threads 106 on an outer surface of the cap 104, and a vent 108 is provided on an portion of cap 104 distal from threads 106.

Figure 5:
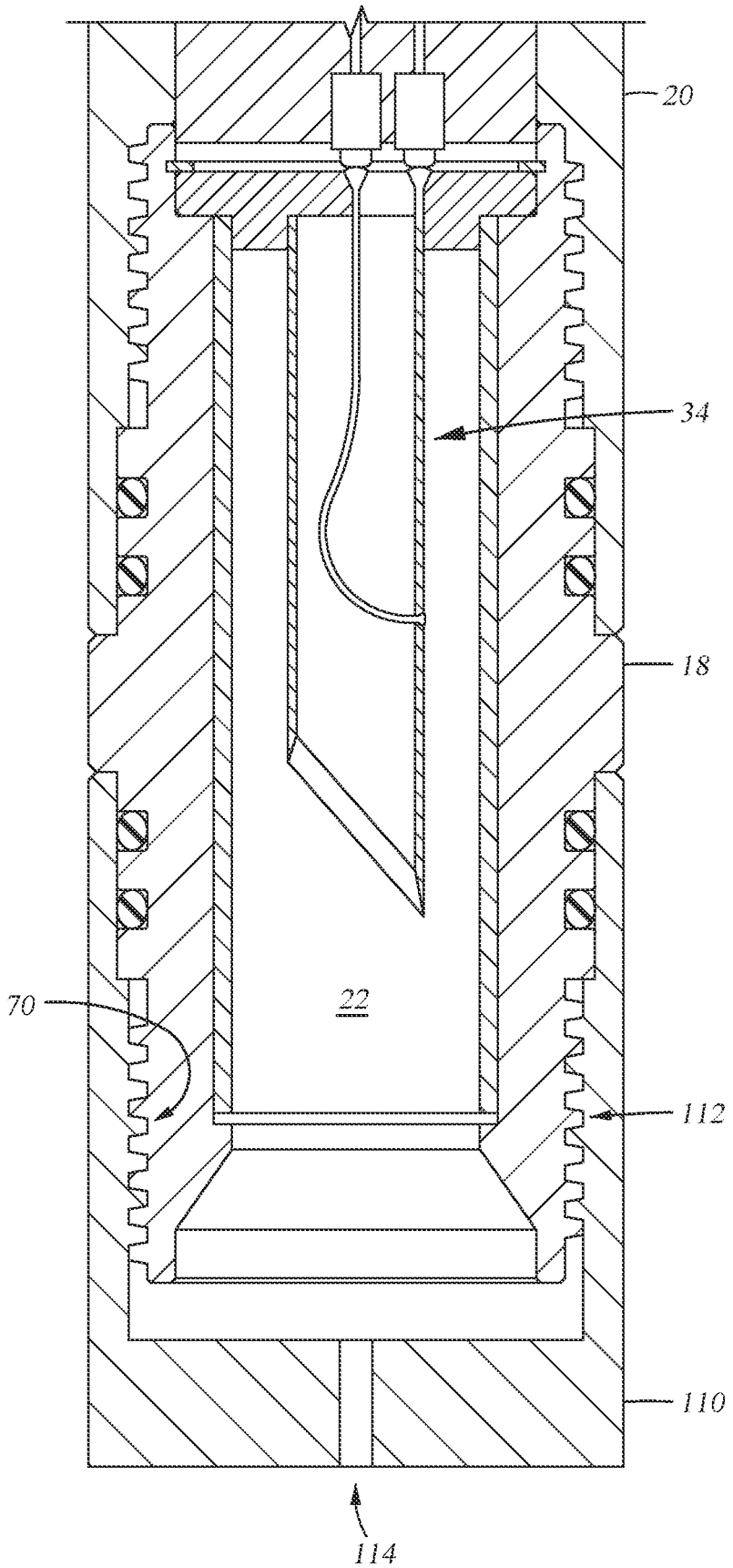
FIG. 5 is a side sectional view of an example of shipping a portion of the initiator having an initiator.

Shown in a side sectional view in FIG. 5 is an example of the chassis assembly 34 in the transportation configuration. As shown, the tandem sub 18 couples to the upper body 20 with the chassis assembly 34 within, and where a cap 110 mounts onto the open end of the tandem sub 18. Similar to cap 104 of FIG. 4, cap 110 is generally cylindrical and equipped with threads 112 that engage threads 70 on the tandem sub 18. Also included with cap 110 is a vent 114 that projects through an axial end and provides venting from ambient into the bore 22 of the tandem sub 18. In a non-limiting example of operation, the tubular assemblies made up of the tandem sub 18, upper body 20 and chassis assembly 34 are produced and shipped separate from the tubular assembly made up of the gun body 16 and cartridge 24. Advantages of shipping the chassis assembly 34 separate from the cartridge 24 eliminates the requirements of governing regulatory compliance encountered when shipping an assembled initiator.

Figure 6:
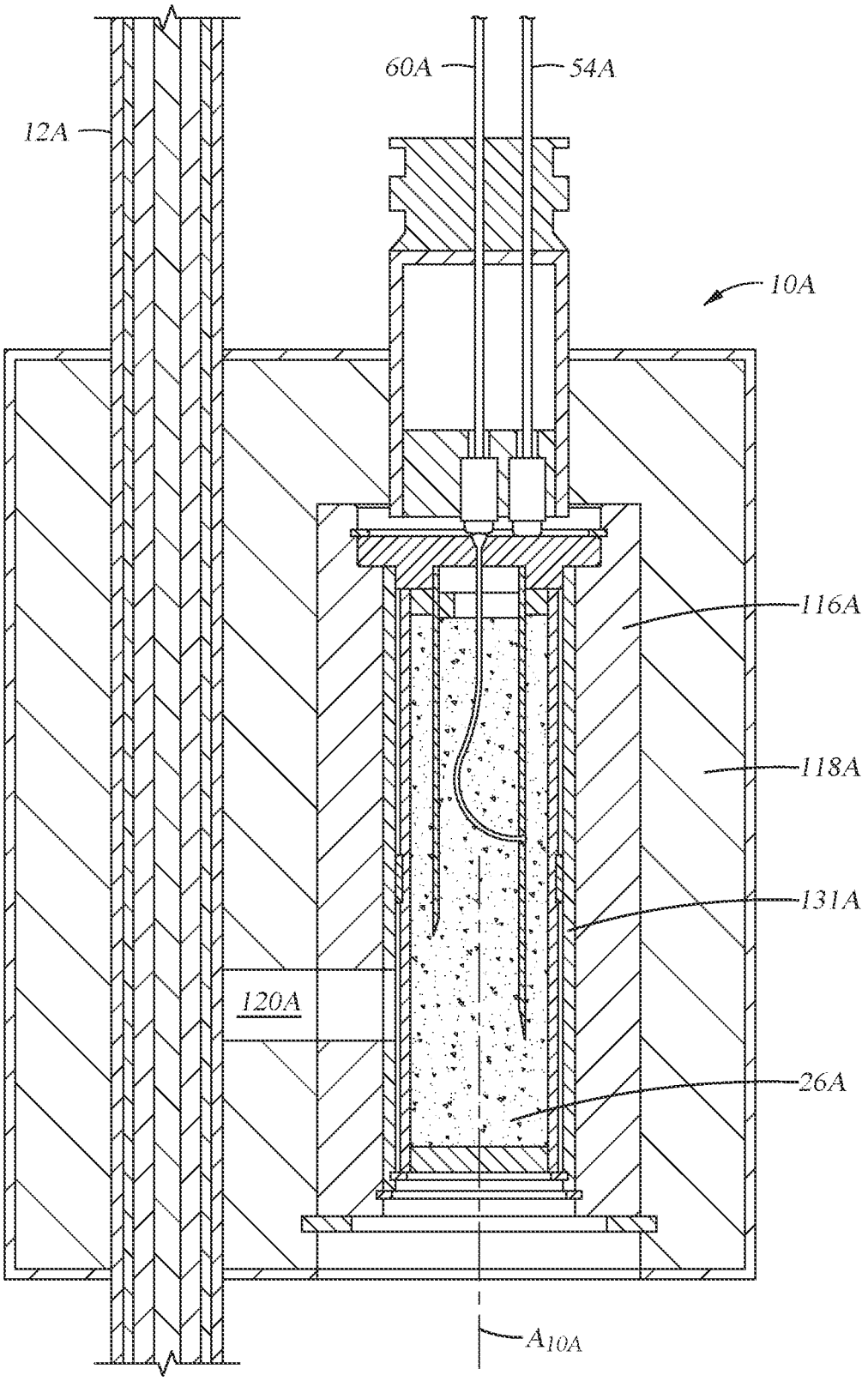
FIG. 6 is a side sectional view of an example of an alternate example of the initiator of FIG. 1.

In FIG. 6 shown in a side sectional view is an alternate example of an initiator 10A. In this example, initiator 10A includes an annular housing 116A around housing 131A and which is mounted within a block body 118A. Block body 118A is coupled with a detonation cord 12A shown extending substantially parallel with axis $A_{10A}$ in a port 120A shown projecting radially outward through the housing 116A and the block body 118A and which provides a communication path for a detonation wave to extend from the explosive 26A and to the detonation cord 12A.

In a nonlimiting example of operation, first and second tubular assemblies are produced at a manufacturing facility 122 (FIG. 1), where first tubular assembly includes the chassis assembly 34, tandem sub 18, and upper body 20; and the second tubular assembly includes the cartridge 24 and the gun body 16. Further in this example, manufacturing facility 122 is distal from where the initiator 10 is formed by the operation described above with regard to FIG. 3. In an example, the initiator 10 is assembled at a wellsite or other location. In alternatives, the first and second tubular assemblies are shipped separate from one another and so that restrictions imposed by governmental authorities are not applicable, which do arise in situations where an initiator is formed so that accidental discharge can bring about detonation of high explosive within the initiator. Further optionally, the first and second tubular assemblies respectively having the cartridge 24 and chassis assembly 34 are produced at separate manufacturing facilities that are alternatively at different locations, and separately shipped to a location where the initiator 10 is then assembled. Alternatives of shipping include ground transportation using vehicles on roadways, through the air with aircraft, within a locomotive, and also a seagoing vessel, and combinations thereof.

Figure 7:
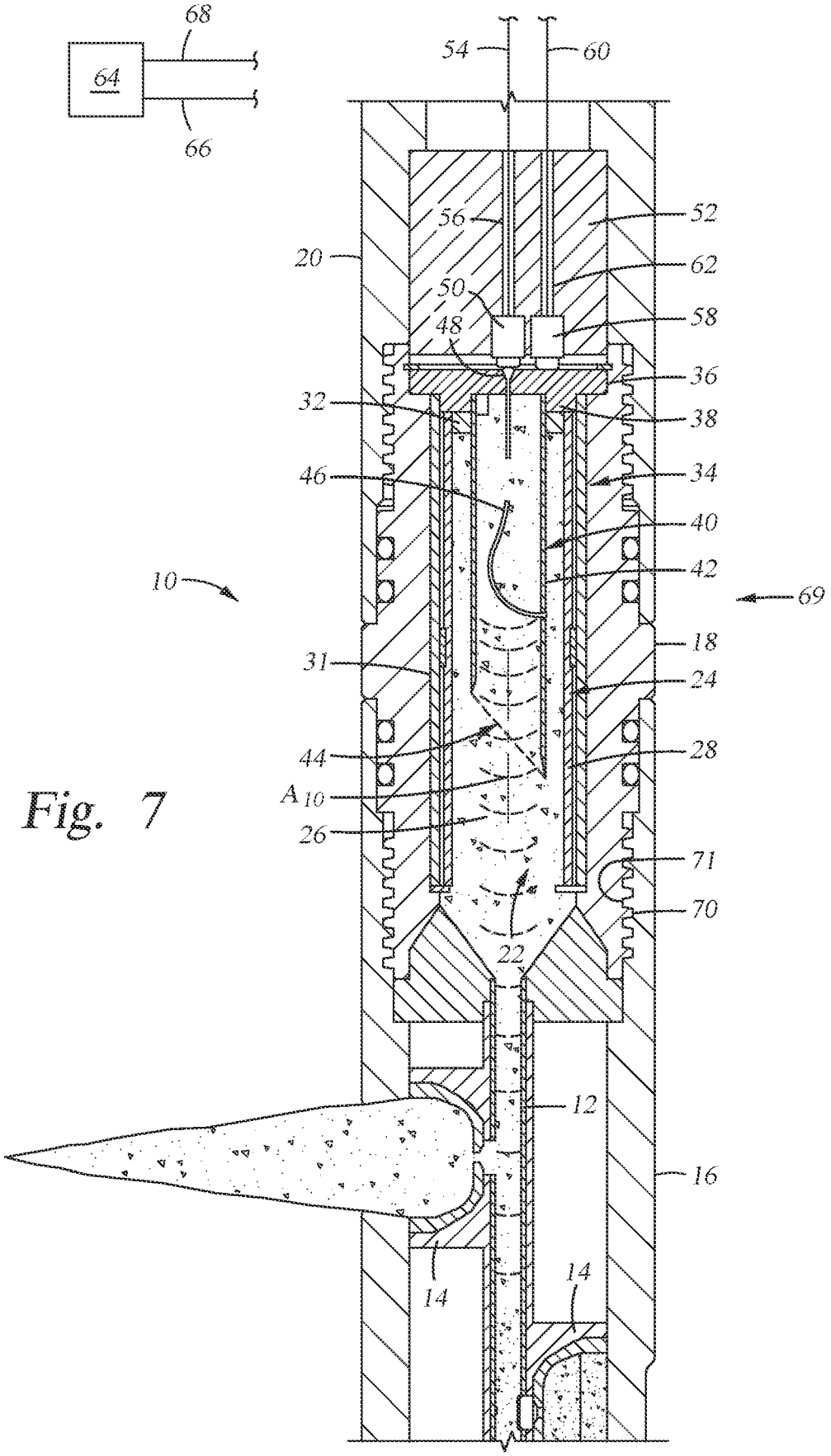
FIG. 7 is a side sectional view of an example of instigating detonation within the initiator of FIG. 1.

Shown in a side sectional view in FIG. 7 is an example of instigating a reaction in an energetic material in which electricity from power source 64 is delivered via leads 66, 68 to lines 60, 54. The amount of electricity delivered results in an electrical flow through bridge wire 46 exceeding the electron carrying capability of bridge wire 46 so that it radiates and/or fractures and results in a discharge within the explosive 26. Energy released from the initiator discharge creates an initial detonation wave that projects towards the detonation cord 12 in a direction substantially parallel with axis $A_{10}$. The initial detonation wave causes a subsequent detonation wave within the detonation cord 12 for detonating the high explosive within shape charges 14. Alternatively, with regard to FIG. 6, the detonation wave from the explosive 26A projects radially outward through passage 120A. In alternatives, the energetic material is within a mechanism other than a perforating string 72 (FIG. 2) such as those described above that include pipe cutters, bridge plug setters, and packers.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A method of instigating a reaction in an energetic material comprising:

obtaining a first tubular assembly having a chassis assembly mounted within that comprises a penetrator made up of an elongated annular barrel, a tip on an open end of the barrel, and a bridge wire inside the barrel;

obtaining a second tubular assembly having a cartridge mounted within that comprises an annular sleeve having high explosive disposed within;

forming an initiator by urging the tip into the high explosive to bring the bridge wire into close contact with the high explosive and coupling together the first and second tubular assemblies, where the initiator is formed at a location that is distal from where the first and second tubular assemblies are assembled;

mounting first and second caps respectively onto the first and second assemblies prior to transporting the first and second assemblies; and communicating a detonation of the high explosive to the energetic material.

2. The method of claim 1, wherein the first tubular assembly is transported, separate from the second tubular assembly, to where the initiator is formed.

3. The method of claim 1, wherein the first and second tubular assemblies are assembled distal from one another.

4. The method of claim 1, wherein the detonation of the high explosive is initiated by energizing the bridge wire with a designated amount of electricity that causes the bridge wire to fracture.

5. The method of claim 1, wherein the energetic material is part of a system selected from the group consisting of a perforating string, a bridge plug setting tool, and a pipe cutter.

6. The method of claim 1, further comprising venting spaces inside the first and second caps during the step of transporting.

7. The method of claim 1, wherein the detonation of the high explosive is communicated in a direction selected from the group consisting of parallel with an axis of the initiator and lateral to the axis of the initiator.

8. The method of claim 1, wherein during insertion of the penetrator into the high explosive, the penetrator is rotationally static and the cartridge rotatable with respect to the penetrator.

9. A system for instigating a reaction in an energetic material comprising:

an initiator comprising, a first tubular assembly comprising an annular first tubular, a cartridge assembly coaxially mounted within the first tubular, the cartridge assembly comprising a penetrator that includes an annular barrel having an open end and an elongated bridge wire inside the barrel; and a second tubular assembly comprising an annular second tubular, a cartridge comprising an annular sleeve, and high explosive disposed inside the sleeve that is in close contact with the bridge wire when the penetrator is received inside the sleeve, the high explosive is strategically oriented, so that detonation of the high explosive communicates to the energetic material, the second tubular assembly selectively changeable between a transportable configuration separate and decoupled from the first tubular assembly and an engaged configuration coupled with the first tubular assembly and in which the penetrator is inserted inside the sleeve; and a turnable assembly mounted on an end of the cartridge opposite where the penetrator inserts into the sleeve and that is rotatable with respect to the penetrator.

10. The system of claim 9, wherein the energetic material is part of a system selected from the group consisting of a perforating string, a bridge plug setting tool, and a pipe cutter.

11. The system of claim 9, further comprising an electrical source in communication with the bridge wire that selectively provides electricity to the bridge wire in an amount to result in detonation of the high explosive.

12. The system of claim 9, wherein the high explosive is selected from the group consisting of thermite, high explosive, non-compressed high explosive, a variable density secondary explosive, and combinations.

13. A method of instigating a reaction in an energetic material comprising:

obtaining a first tubular assembly having a chassis assembly mounted within, the chassis assembly comprising a penetrator made up of an elongated annular barrel, a tip on an open end of the barrel, and a bridge wire inside the barrel;

obtaining a second tubular assembly that comprises an annular member having a cartridge mounted within, the cartridge comprising, an annular sleeve, high explosive disposed within the annular sleeve, and a coupling engaging the annular sleeve to support structure within the annular member; and forming an initiator by coupling together the first and second tubular assemblies so that the tip penetrates into the high explosive to bring the bridge wire into direct contact with the high explosive.

14. The method of claim 13, wherein coupling together the first and second tubular assemblies comprises engaging threads formed on the first and second tubular assemblies and rotating one of the first or second tubular assembly with respect to the other, wherein the sleeve and the high explosive rotate with respect to the annular member and the sleeve and the high explosive are rotationally static with respect to the penetrator.

15. The method of claim 13, where the initiator is formed at a location that is distal from where the first and second tubular assemblies are assembled, the method further comprising mounting first and second caps respectively onto the first and second assemblies prior to transporting the first and second assemblies.

16. The method of claim 13, further comprising initiating detonation of the high explosive by energizing wires in communication with the bridge wire, the wires connected to an end of the chassis assembly distal from the tip, wherein the wires are substantially rotationally static when the first and second tubular assemblies are coupled together.

17. The method of claim 13, further comprising initiating detonation of the high explosive by energizing wires in communication with the bridge wire to produce heat radiance in the high explosive.

18. The method of claim 13, wherein the initiator provides detonation for a device selected from the group consisting of a perforating gun, a tool for setting a plug downhole, a thermal cutter, a pipe cutter, and a wellbore packer initiator.

* * * * *